US009873493B2

(12) United States Patent
Denney, Jr. et al.

(10) Patent No.: US 9,873,493 B2
(45) Date of Patent: Jan. 23, 2018

(54) NESTING FENDERS

(71) Applicant: Contact Left, LLC, Seattle, WA (US)

(72) Inventors: John D. Denney, Jr., Seattle, WA (US); Robert Carrasca, Seattle, WA (US); Christopher Hamlin, Seattle, WA (US)

(73) Assignee: Contact Left, LLC, Seattle, WA (US)

( * ) Notice: Subject to any disclaimer, the term of this patent is extended or adjusted under 35 U.S.C. 154(b) by 0 days.

(21) Appl. No.: 15/633,605

(22) Filed: Jun. 26, 2017

(65) Prior Publication Data

US 2017/0305513 A1 Oct. 26, 2017

Related U.S. Application Data

(60) Provisional application No. 62/443,738, filed on Jan. 8, 2017, provisional application No. 62/492,852, filed on May 1, 2017.

(51) Int. Cl.
*B63B 59/02* (2006.01)
*E02B 3/26* (2006.01)

(52) U.S. Cl.
CPC ..... *B63B 59/02* (2013.01); *E02B 3/26* (2013.01)

(58) Field of Classification Search
CPC ..... B63B 59/02; E02B 3/26
USPC ..... 114/219
See application file for complete search history.

(56) References Cited

U.S. PATENT DOCUMENTS 3,060,463 A * 10/1962 Pentzien ..... F16L 1/24 114/267
3,286,680 A * 11/1966 Caretta ..... B63B 59/02 114/219
4,584,958 A * 4/1986 Green ..... B63B 59/02 114/219
D504,344 S * 4/2005 Gotell ..... D10/107

* cited by examiner

*Primary Examiner* — Stephen P Avila
(74) *Attorney, Agent, or Firm* — Puget Patent; Michael Gibbons

(57) ABSTRACT

An arrangement of fenders nested together for compact storage, the fenders including two or more cylindrical bodies having a cavity accessed through the fender top, the fenders being similar shape but graduated in size such that the cavity of a larger fender tensionally receives the next smaller sized fender, the outer diameter of the smaller fender equal to the inner diameter of the larger fender cavity. A fender has a rigid inner core surrounded by a compressible shell made of foam or similar material. The inner core has attachment points for a rope or line. The smallest nesting fender in the set has a cavity diameter sized to fit a commercially-available, off-the-shelf fender. The fenders may be separated and deployed at individual locations on a vessel, or kept together and deployed as a single fender capable of absorbing a greater impact than any of the fenders individually would absorb.

20 Claims, 5 Drawing Sheets

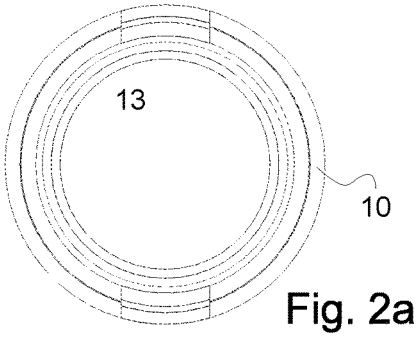
Fig. 2a
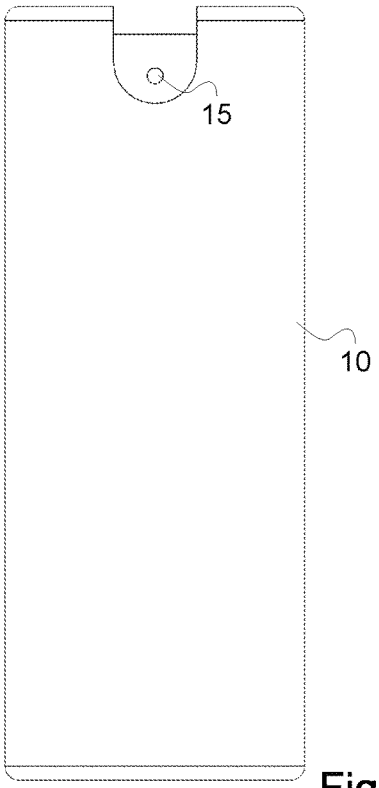
Fig. 2b
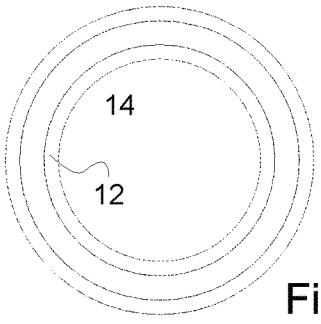
Fig. 2c
Fig. 2d
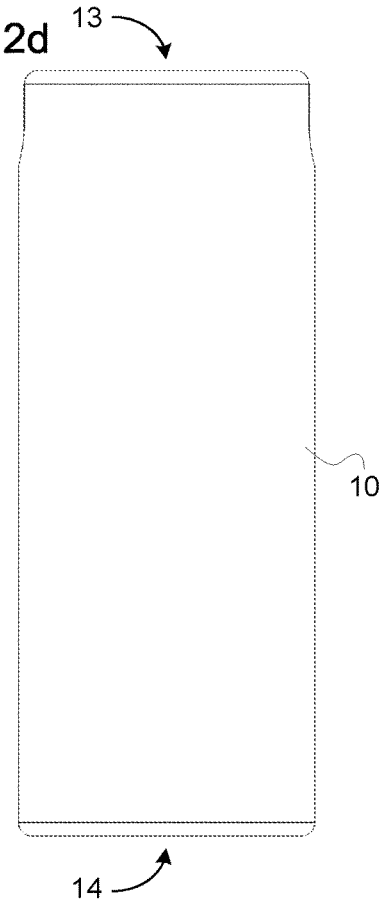

Fig. 3a
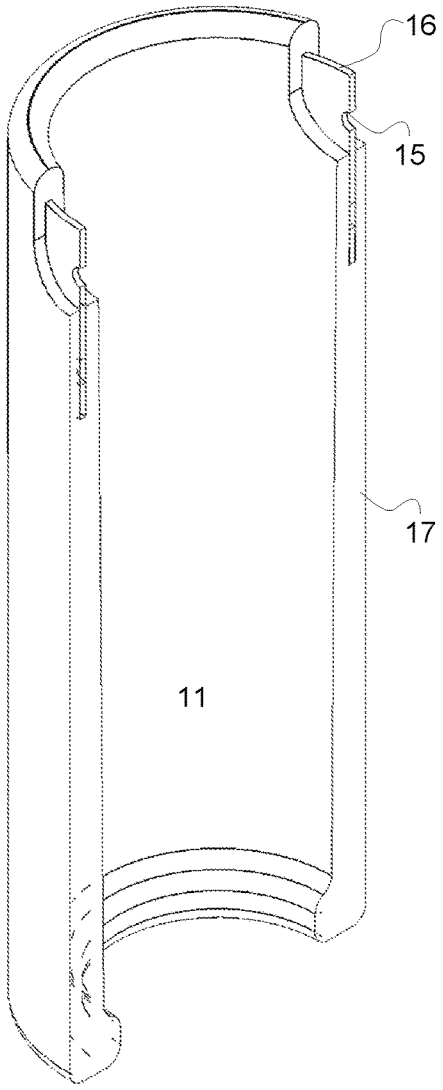
Fig. 3b
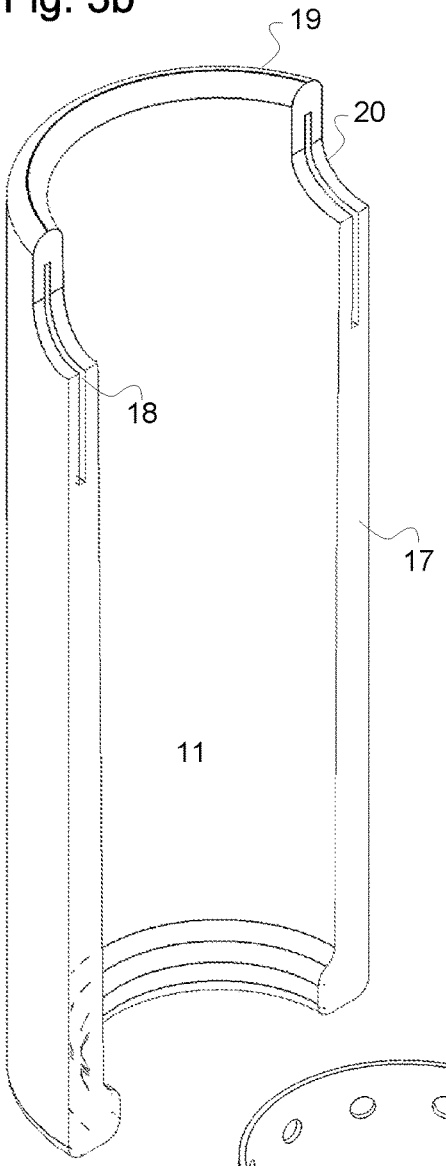
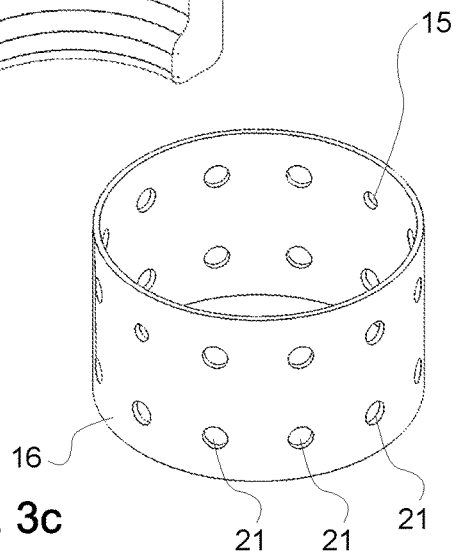
Fig. 3c

NESTING FENDERS

PRIORITY CLAIM

The present application is related to and/or claims the benefits of the earliest effective priority date and/or the earliest effective filing date of the below-referenced applications, each of which is hereby incorporated by reference in its entirety, to the extent such subject matter is not inconsistent herewith, as if fully set forth herein:

(1) this application constitutes a non-provisional of U.S. Provisional Patent Application No. 62/443,738, entitled NESTING FENDERS, naming John D. Denney as the inventor, filed Jan. 8, 2017, which is an application of which is entitled to the benefit of the filing date; and (2) this application constitutes a non-provisional of U.S. Provisional Patent Application No. 62/492,852, entitled NESTING FENDERS, naming John D. Denney, Jr. as the inventor, filed May 1, 2017, which is an application of which is entitled to the benefit of the filing date.

FIELD OF THE INVENTION

This invention relates generally to marine vessels such as boats and fenders for them, and, more specifically, to nesting fenders.

BACKGROUND OF THE INVENTION

In boating, a fender is a bumper used to absorb the kinetic energy of a boat or vessel berthing against a jetty, quay wall or other vessel. Fenders are used to prevent damage to boats, vessels and berthing structures. Contemporary "rubber" fenders evolved from commercial fishing buoys at least in the 1970's, and have not significantly changed. Primarily they are inflatable bladders in a shape of a ball or cylinder. They are difficult to store and require significant space. Inflatable designs exist but require additional effort to inflate and deflate in conjunction with their use and storage. Accordingly, a need exists for fenders which require less storage than the typical fender without requiring inflation mechanisms to be carried on board the vessel.

DESCRIPTION OF RELATED ART

U.S. Pat. No. 3,145,686 issued to John B. Blythe on Mar. 29, 1963 discloses a combination boat bumper and container. Blythe does not specifically discuss storing a smaller bumper within the containment section of a larger bumper.

U.S. Pat. No. 3,286,680 to Robert Caretta on Jul. 20, 1965 discloses a plurality of cylindrical fenders in which an annular cavity having an aperture at a bottom portion of a first fender may receive an upper hemispherical portion of a second, equally-sized fender for the purpose of creating a very long, singular fender. Caretta does not disclose differently-sized fenders so that a first fender may receive an entirety of a second, smaller fender for storage of the second fender.

U.S. Pat. No. 6,357,377 to Albert Santelli, Jr. on Mar. 19, 2002 discloses a fender having a stacked arrangement of pleated sections which collapses vertically to form a compact article for storage. Santelli does not disclose an arrangement where an entire fender may fit within another fender for optimally-reduced storage requirements.

WIPO Patent Application Publication No. WO 2013/020910, submitted on behalf of Matteo Gencarelli and published on Feb. 14, 2013, discloses a segmented boat fender in which a plurality of tubular members of graduated diameter but constant height can be extended telescopically to form a marine fender and can be collapsed for storage with all but one of the tubular members fitting inside the member having the largest diameter. Gencarelli does not teach the individual tubular members being deployable as an individual boat fender.

U.S. Pat. No. 5,184,745 to Petrina Havens on Feb. 9, 1993 is an example of a disclosure of a plurality of containers which are nestable to conserve storage space. A number of such disclosures exist in the relevant technology area. None of said disclosures teach nesting of a plurality of graduated-sized containers that are suitable for absorbing kinetic energy resulting from two objects forcefully coming together.

SUMMARY

The instant application discloses a plurality of fenders of graduated size, each of which has a cavity for receiving the next smaller sized fender for storage. The fenders are suitable for use in a marine environment and are constructed to absorb the kinetic energy resulting from a boat berthing against a dock, another boat, or similar object. The fender has a cylindrical body including a stiff, cylindrical inner core that is surrounded by a softer outer shell which compresses upon impact. A pliable material may cover the exterior of a nesting fender for protection of the fender from the harsh marine environment. The cavity for receiving other fenders for storage is also cylindrical and is accessible through an aperture in the top of the fender. A smaller aperture through the bottom of the fender is formed by an interior lip of the outer shell on which the next-sized down fender rests when nested inside the cavity. A rope or line may be attached to the inner core via a grommet or other attachment point on the inner core, which provides a more robust attachment point than would be possible with an attachment of the rope to the softer outer shell that may be constructed of foam or similar compressible material.

The relative diameters of the graduated-sized fenders are such that the inner diameter of the cylindrical cavity of a larger fender is substantially the same as the outer diameter of the next sized down fender. The diameters are sized to provide tension between the outer surface of the cylindrical body of the smaller fender and the inner surface of the cylindrical cavity of the larger fender for retention of the smaller fender within the larger fender. The tension provided is such that the fenders will remain nested when at rest or even when displaced by the boat in motion (e.g. if the nested fenders are upside-down) but without so much tension that the fenders are unable to be nested or separated by hand. In addition to providing the tension for keeping the fenders nested, the relative diameters ensure that the entire cavity of the larger fender is utilized by the smaller fender with no wasted interior space, maximizing the storability of the nested fenders. The smallest nesting fender of the set may be sized to receive a commercially-available off-the-shelf fender of the type that does not have an interior cavity, such as an F Series fender manufactured by Polyform US (an example of which is viewable on the World Wide Web at www.polyformus.com/boat-fenders/f-series), ensuring that every volumetric portion of the cavity of the largest fender is used for other fenders and optimizing storability.

The resulting differently-sized fenders are deployable about the boat for different purposes. For example, the largest fenders may be deployed along a side of the boat adjacent to an immovable jetty, and smaller fenders may be deployed along an opposing side of the boat adjacent to another boat floating in the water. In this way, the fenders may be deployed to optimally absorb the relative impact of the adjacent bodies. The largest fenders, which are capable of absorbing the most impact force, can be placed nearest the immovable object (e.g. a jetty) where impact forces are likely to be largest. Smaller fenders, which can absorb relatively less impact force, are placed nearest to floating objects like other boats where impact forces are likely to be lessened because some energy from impact is consumed by the rebound of the other boat subsequent to impact. In a different usage, the fenders may be deployed in a nested configuration (i.e. a smaller fender within a larger fender) to provide an even stronger unit which is capable of absorbing a relatively larger impact than a single nesting fender acting alone.

The foregoing is a summary and thus contains, by necessity, simplifications, generalizations and omissions of detail; consequently, those skilled in the art will appreciate that the summary is illustrative only and is not intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings:

FIGS. 2*a*-2*d* are a top view, a side view, a bottom view, and a front view of a nesting fender.

FIG. 3*a* is a cross-sectional view of the cylindrical body of a nested fender showing the rigid inner core surrounded by the compressible outer shell.

FIG. 3*b* is a cross-sectional view of the cylindrical body of the nested fender from the same perspective as that of FIG. 3*a*, but with the rigid inner core not shown to bring the hollow within the compressible outer shell into view.

FIG. 3*c* is a perspective view of the rigid inner core.

DETAILED DESCRIPTION

Specific details of certain embodiments of the invention are set forth in the following description and in the figures to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1A:
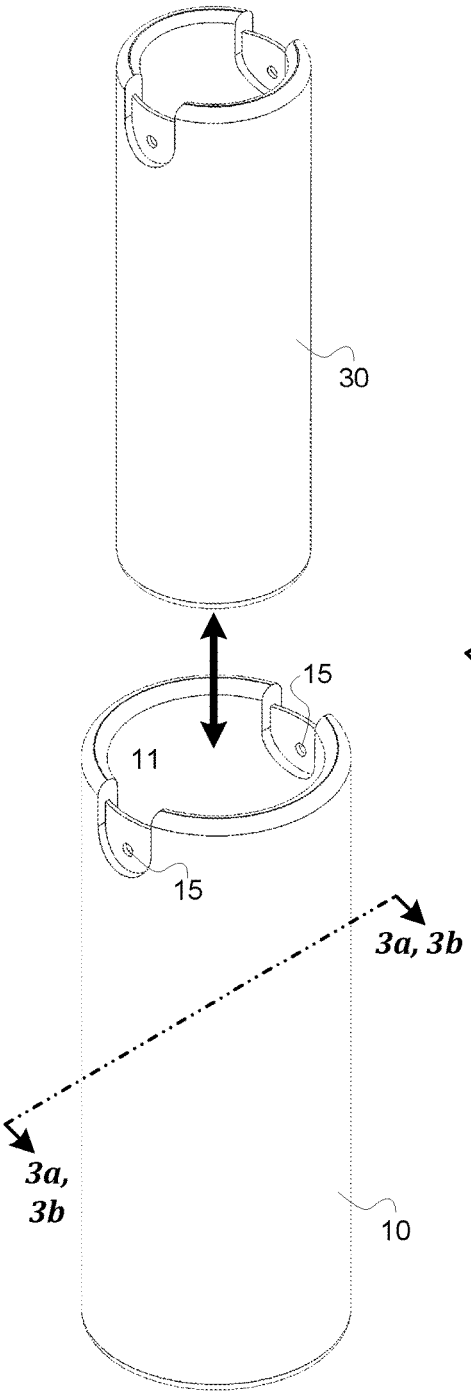
FIG. 1*a* is an exploded view of a pair of nested fenders.
Figure 1B:
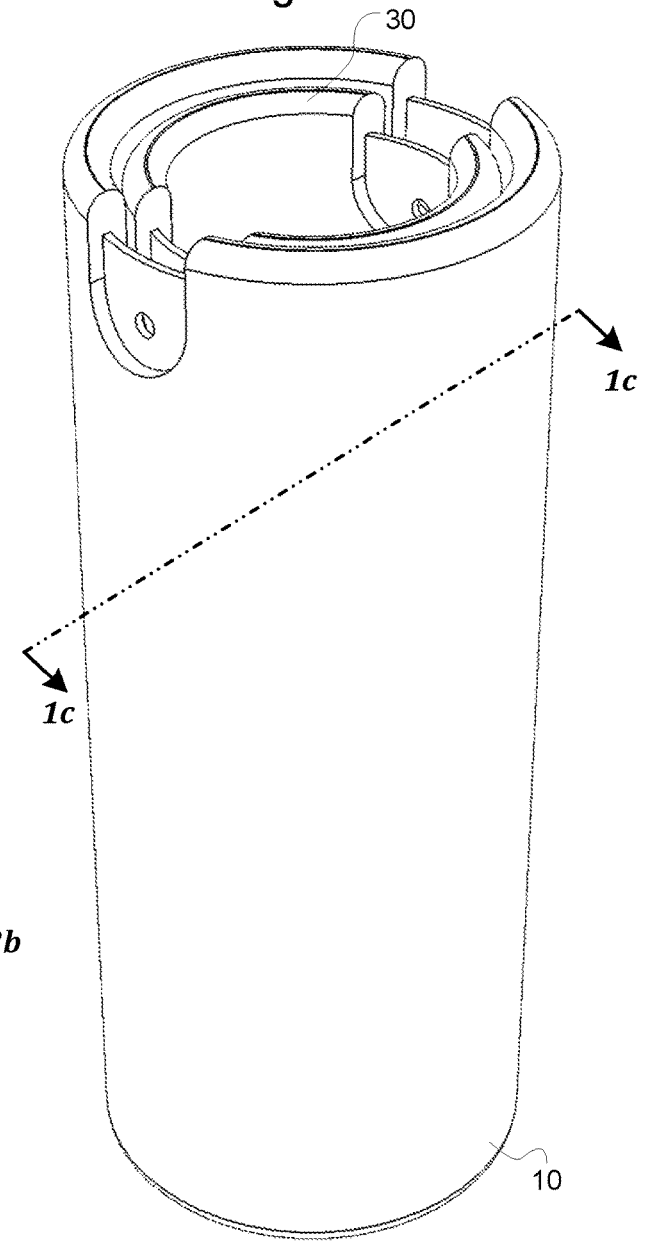
FIG. 1*b* is an isometric view of a pair of nested fenders in which a smaller fender is nested inside a cavity of a larger fender.
Figure 1C:
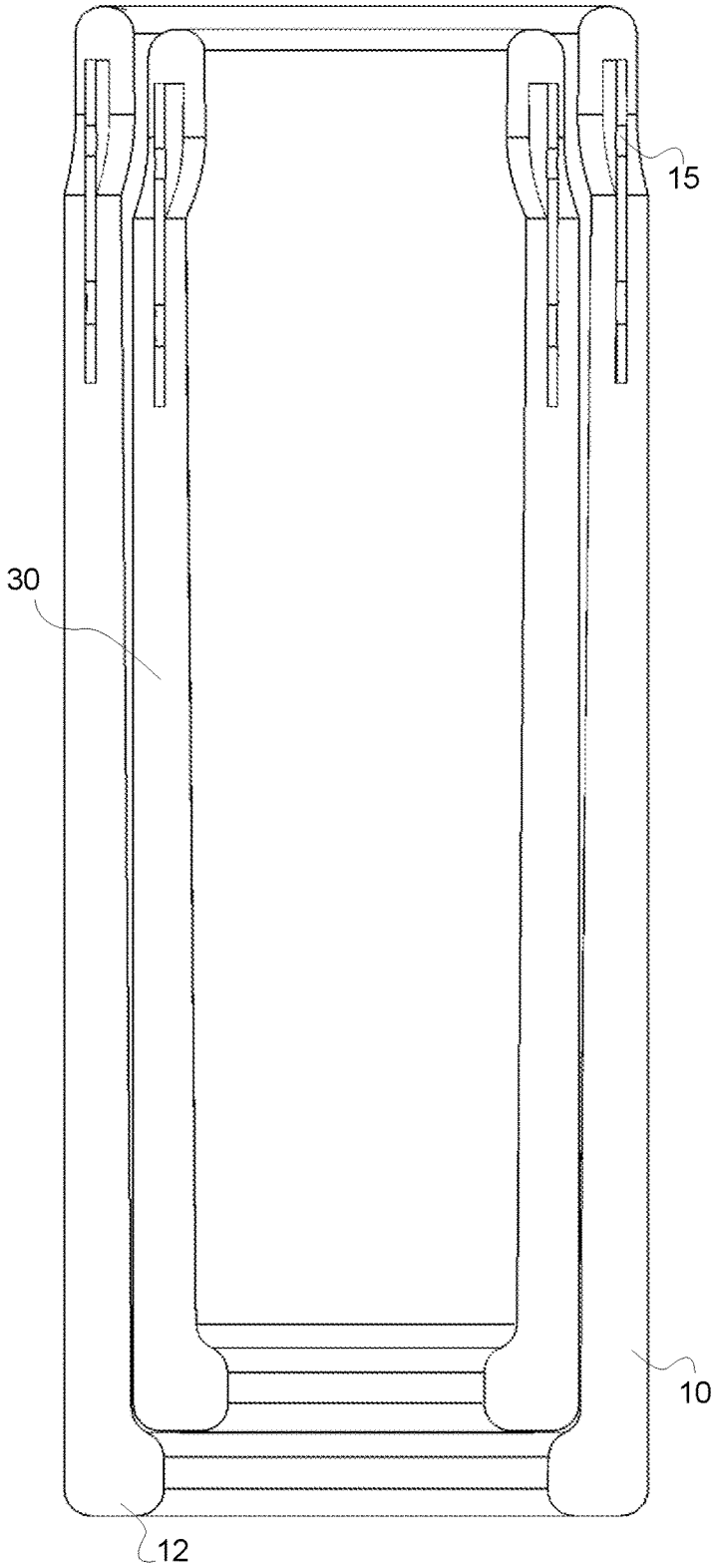
FIG. 1*c* is a cross-sectional view of the pair of nested fenders in which the smaller fender is nested inside the cavity of the larger fender.

A pair of nesting fenders is shown in FIGS. 1*a*-1*c*, including a larger fender 10 and a smaller fender 30. Two fenders, a larger fender (a first fender, e.g.) and a smaller fender (at least one other fender, e.g.), are depicted throughout the drawings. It will be understood that an arrangement of nesting fenders is not limited to two fenders, and that three, four, five or another larger number of nesting fenders are all envisioned as possible embodiments. For clarity of the drawings and a compact presentation of the invention, only two fenders are shown. While the fenders are depicted as separated in FIG. 1*a*, the fenders are shown nested in FIGS. 1*b* and 1*c* with the smaller fender having been inserted into a cavity of the larger fender 11. Nesting a smaller fender inside the cavity of the larger fender involves placing the bottom of the smaller fender into the aperture through the top surface of the larger fender and pressing the smaller fender down until the smaller fender comes to rest on a lip of the larger fender 12. An attachment point 15 is present for a line or a rope (not shown) to be coupled with the fender. The fender arrangement is sized such that the height of a smaller fender is received by the interior cavity of the larger fender in its entirety. The smaller fender is substantially the same height as, or less than, the height of the larger fender less the height of the lip of the larger fender.

Turning to FIGS. 2*a*-2*d*, it may be seen that a nesting fender 10 has a cylindrical body, with an aperture through the top of the cylindrical body 13 and another aperture through the bottom of the cylindrical body 14. The aperture through the top of the cylindrical body leads to the cavity for receiving a smaller fender, which has an annular (i.e. cylindrical) shape with an inner diameter that is substantially the same as the outer diameter of the next-smallest size fender. The diameter of the aperture through the top of the cylindrical body is thus the same as the inner diameter of the cavity. The aperture through the bottom surface of the cylindrical body has a smaller diameter than that of the other aperture or of the cavity, creating the aforementioned lip 12. The lip presents a shelf on which the fender inserted into the cavity rests, as well as strengthens the bottom section of the fender through making it more crush-resistant. Yet the aperture through the bottom surface still permits water to pass through the bottom surface of the fender, preventing the fender from filling with water which would make the fender heavy. An attachment point for a line or a rope is formed by a channel through a portion of the cylindrical body 15. The fender may have one, two or more attachment points.

FIG. 3*a* presents a cross-sectional view of a fender depicting the rigid inner core 16 and the compressible outer shell 17. FIG. 3*b* presents a cross-sectional view of the fender from the same perspective as that of FIG. 3*a*, but with the rigid inner core not shown to bring the hollow within the compressible outer shell 18 into view. The rigid inner core is disposed within the hollow of the compressible outer shell, nearest the top portion of the cylindrical body of the fender. A top rim 19 of the compressible outer shell has a portion cut away from the rim to expose a portion of the rigid inner core. Through this cutout 20, the channel 15 which defines the attachment point for a rope or line is accessible.

Turning to FIG. 3*c*, it may be seen that the rigid inner core has a plurality of holes 21 which act to create tension between the rigid inner core and the compressible outer shell, biasing the rigid inner core against rotating axially or spinning within the hollow of the compressible outer shell. The channel 15 through the wall of the rigid inner core defines the attachment point. As previously stated, one, two or more attachment points may be present within the rigid inner core and accessible via cutouts in the compressible outer shell. The rigid inner core may be fabricated from rubber or a hard plastic material or be polymerized to assure durability of the core, and to provide a more suitable attachment point via the channel through the wall of the core. A grommet (not shown) may be used at attachment point 15 to reinforce the channel cut through the rigid inner core that provides the attachment point. Where two attachment points are present (i.e. two channels cut through the rigid inner core providing the two attachment points), they may be disposed on opposing sides of the rigid inner core and adjacent to the upper rim of the rigid inner core.

The compressible outer shell is fabricated with foam or similar material. As previously mentioned, the inner diameter of the interior cavity 11 of the compressible outer shell is substantially the same as the outer diameter of the compressible outer shell of the next-smallest sized fender. "Substantially the same" may mean exactly the same, or mean within a reasonable manufacturing tolerance for foam articles (e.g. +/−0.1 inches), or may mean that the outer diameter of the smaller fender is slightly larger than the interior cavity inner diameter of the larger fender such that the compressible outer shells of the smaller and larger fenders compress slightly in order to frictionally insert and retain the smaller fender within the larger fender by hand.

Figure 4A:
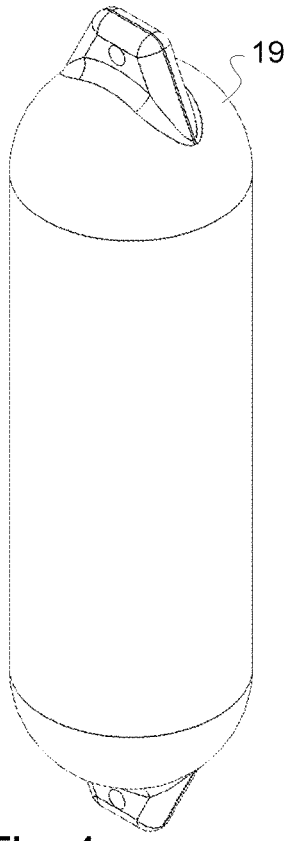
Fig. 4a (PRIOR ART)
FIG. 4*a* is a perspective view of a prior art commercially-available, off-the-shelf marine fender.
Figure 4B:
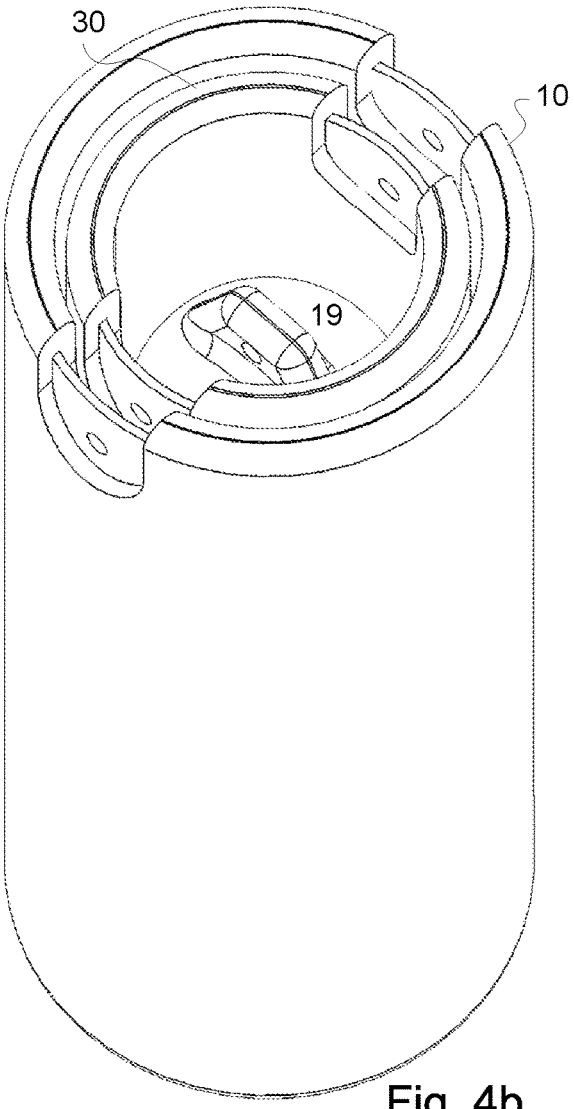
FIG. 4*b* is a perspective view of a nesting fender arrangement in which the smallest nesting fender has received a commercially-available, off-the-shelf marine fender.

Turning to FIGS. 4*a* and 4*b*, as previously mentioned, a prior-art commercially-available, off-the-shelf (COTS) fender 19, such as a Polyform F-series fender, may be used in concert with the nesting fender arrangement to provide even better maximization of space utilization. That is, the smallest nesting fender 30 of the nesting fender arrangement may be constructed such that the inner diameter of the interior cavity is sized to be substantially the same as the outer diameter of the cylindrical COTS fender. The inner diameter of the smallest nesting fender may otherwise be slightly smaller than the outer diameter of the cylindrical COTS fender so as to compress slightly when the COTS fender is inserted so as to tensionally retain the COTS fender. The COTS fender may be an inflatable fender since deflation of the fender is not necessary for its storage as the interior cavity of the smallest nesting fender is already sized perfectly to receive the COTS fender.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A nesting fender arrangement, comprising:

a first fender, including at least:

a cylindrical body, including at least:

a compressible outer shell; and a rigid inner core, the rigid inner core disposed within a hollow interior to the compressible outer shell and adjacent to an upper rim of the compressible outer shell; and an interior cavity, the interior cavity including at least an annular shape with a top aperture, the top aperture leading to the interior cavity through a top surface of the cylindrical body; and at least one other fender, the at least one other fender including at least a cylindrical body diameter that is substantially the same as an interior cavity diameter of the first fender.

2. The nesting fender arrangement of claim 1, wherein the first fender removably receives an entirety of the at least one other fender within the interior cavity through the top aperture.

3. The nesting fender arrangement of claim 1, wherein the at least one other fender includes at least a cylindrical height equal to or less than a height of the interior cavity of the first fender.

4. The nesting fender arrangement of claim 1, wherein the upper rim of the compressible outer shell has at least one cutout, the at least one cutout exposing at least one upper rim portion of the rigid inner core.

5. The nesting fender arrangement of claim 4, wherein the rigid inner core includes at least one channel disposed through the at least one rim portion of the rigid inner core, the at least one channel accessible via the at least one cutout exposing the at least one upper rim portion of the rigid inner core.

6. The nesting fender arrangement of claim 5, wherein the at least one channel disposed through the at least one rim portion of the rigid inner core includes at least one grommet.

7. The nesting fender arrangement of claim 6, wherein the upper rim of the compressible outer shell has at least two cutouts, the at least two cutouts diametrically opposing one another, the at least two cutouts exposing at least two upper rim portions of the rigid inner core and at least two grommets, one grommet disposed through each of the at least two upper rim portions.

8. The nesting fender arrangement of claim 4, wherein a portion of the rigid inner core not exposed by the at least one cutout has a plurality of holes.

9. The nesting fender arrangement of claim 8, wherein the rigid inner core is fabricated of rubber and the compressible outer shell is fabricated of foam, the plurality of holes tensionally biasing the rigid inner core from rotating axially within the hollow interior to the compressible outer shell.

10. The nesting fender arrangement of claim 1, wherein the at least one other fender is tensionally retained within the interior cavity of the first fender.

11. The nesting fender arrangement of claim 10, wherein at least one of an interior cylindrical surface of interior cavity or an exterior cylindrical surface of the at least one other fender compresses, at least partially via the compressible outer shell, for the interior cavity of the first fender to tensionally receive the at least one other fender.

12. The nesting fender arrangement of claim 1, wherein a bottom surface of the cylindrical body has a bottom aperture leading to the interior cavity through the bottom surface.

13. The nesting fender arrangement of claim 12, wherein the bottom aperture leading to the interior cavity through the bottom surface has a smaller diameter than an interior cavity diameter, the smaller diameter of the bottom aperture defining an interior bottom lip of the cylindrical body.

14. The nesting fender arrangement of claim 13, wherein a bottom surface of the at least one other fender rests upon a top portion of the interior bottom lip of the cylindrical body of the first fender upon the interior cavity of the first fender receiving the at least one other fender.

15. The nesting fender arrangement of claim 1, wherein at least one fender has an interior cavity diameter sized to tensionally receive an inflatable fender.

16. The nesting fender arrangement of claim 15, wherein the inflatable fender is not a member of the nesting fender arrangement.

17. A nesting fender arrangement, comprising:

a first fender, including at least:

a cylindrical body, including at least:

a compressible outer shell;

a rigid inner core disposed within a hollow interior to the compressible outer shell and adjacent to an upper rim of the compressible outer shell, an upper rim portion of the rigid inner core exposed by a cutout of an upper rim of the compressible outer shell; and a grommet disposed through the upper rim portion of the rigid inner core exposed by the cutout;

an interior cavity, the interior cavity including at least an annular shape with a top aperture, the top aperture leading to the interior cavity through a top surface of the cylindrical body; and at least one other fender, the at least one other fender including at least a cylindrical body diameter that is substantially the same as an interior cavity diameter of the first fender, wherein the first fender removably receives an entirety of the at least one other fender within the interior cavity, the at least one other fender tensionally retained within the interior cavity of the first fender at least partially via compressible outer shell compression.

18. A nesting fender arrangement, comprising:

a first fender, including at least:

a cylindrical body, including at least:

a compressible outer shell;

a rigid inner core disposed within a hollow interior to the compressible outer shell and adjacent to an upper rim of the compressible outer shell, a first portion of an upper rim portion of the rigid inner core exposed by a first cutout of an upper rim of the compressible outer shell and a second portion of the upper rim portion of the rigid inner core exposed by a second cutout of the upper rim of the compressible outer shell, the second cutout disposed on an opposing side of the compressible outer shell from the first cutout, the rigid inner core including at least a plurality of holes configured to tensionally retain an axial position of the rigid inner core within the hollow interior to the compressible outer shell;

a first grommet disposed through the first upper rim portion of the rigid inner core exposed by the first cutout; and a second grommet disposed through the second upper rim portion of the rigid inner core exposed by the second cutout;

an interior cavity, the interior cavity including at least an annular shape with a top aperture, the top aperture leading to the interior cavity through a top surface of the cylindrical body; and at least one other fender, the at least one other fender including at least a cylindrical body diameter that is substantially the same as an interior cavity diameter of the first fender and a height that is substantially the same as a height of the first fender less a height of a rim portion of the first fender, wherein the first fender removably receives an entirety of the at least one other fender within the interior cavity, the at least one other fender tensionally retained within the interior cavity of the first fender at least partially via compressible outer shell compression.

19. The nesting fender arrangement of claim 13, wherein the interior bottom lip of the cylindrical body includes one or more cutouts.

20. The nesting fender arrangement of claim 19, wherein the one or more cutouts of the interior bottom lip of the cylindrical body divides the interior bottom lip into three sections.

* * * * *